United States Patent [19]

Weisz

[11] Patent Number: 4,483,263

[45] Date of Patent: Nov. 20, 1984

[54] NEEDLE BIGHT CONTROL MECHANISM FOR A SEWING MACHINE

[75] Inventor: William Weisz, Tenafly, N.J.

[73] Assignee: The Singer Company, Stamford, Conn.

[21] Appl. No.: 614,580

[22] Filed: May 29, 1984

[51] Int. Cl.[3] ..... D05B 3/02; D05B 3/06

[52] U.S. Cl. ..... 112/158 A; 112/158 B; 112/158 C

[58] Field of Search ..... 112/158 A, 158 B, 158 C, 112/158 D, 158 R

[56] References Cited

U.S. PATENT DOCUMENTS

| | | | |
|---|---|---|---|
| 3,254,618 | 6/1966 | Eguchi . | |
| 3,585,876 | 6/1971 | Marsh et al. . | |
| 3,841,246 | 10/1974 | Casner et al. . | |
| 4,077,341 | 3/1978 | Kasuga | 112/158 B |
| 4,441,440 | 4/1984 | Weisz | 112/158 C |
| 4,453,478 | 6/1984 | Weisz | 112/158 B X |

*Primary Examiner*—Peter Nerbun

*Attorney, Agent, or Firm*—William V. Ebs; Robert E. Smith; Edward L. Bell

[57] ABSTRACT

A pushbutton control for a sewing machine is provided with a pivotably mounted carrier for a bell crank which is operably connected to a needle bar. Bight controlling movements are imparted to the needle bar according to the actuation of the bell crank and carrier.

6 Claims, 5 Drawing Figures

NEEDLE BIGHT CONTROL MECHANISM FOR A SEWING MACHINE

BACKGROUND OF THE INVENTION

1. Field of the Invention

The invention relates to pattern and buttonhole control systems for a sewing machine.

2. Description of the Prior Art

Pattern and buttonhole control systems in a sewing machine generally include needle positioning mechanism capable of discriminating between pattern and buttonhole control signals, and of transmitting either through common mechanism to a movable needle bar. The present invention is directed to needle positioning mechanism as described in association with locking mechanism which is selectively operable to positively condition the needle positioning mechanism to transmit either pattern or buttonhole control signals, and thereby prevent the transmission of improper signals to a needle bar.

SUMMARY OF THE INVENTION

Mechanism in accordance with the invention for controlling needle bight in a sewing machine includes a bell crank with an input arm, an output arm, a needle bar actuating link operably connected to the output arm, and a carrier for the bell crank. The bell crank is mounted for pivotal movement about an axis on the carrier, and the carrier is mounted for movement about a different axis affixed on the machine. Means are provided for locking the carrier in a fixed position in the machine to prevent pivotal movement about said fixed axis, and for unlocking the carrier to permit the said pivotal movement thereof. Bight controlling movements for pattern sewing are imparted to the input arm of the bell crank, when the carrier is locked, to thereby cause the bell crank to pivot on the carrier and move the needle bar actuating link. Bight controlling movements for buttonhole sewing are imparted to the input arm of the bell crank and the carrier while the carrier is unlocked to cause the bell crank and carrier to pivot on their respective axes and influence movement of the needle bar link.

DESCRIPTION OF THE PREFERRED EMBODIMENT

Figure 1:
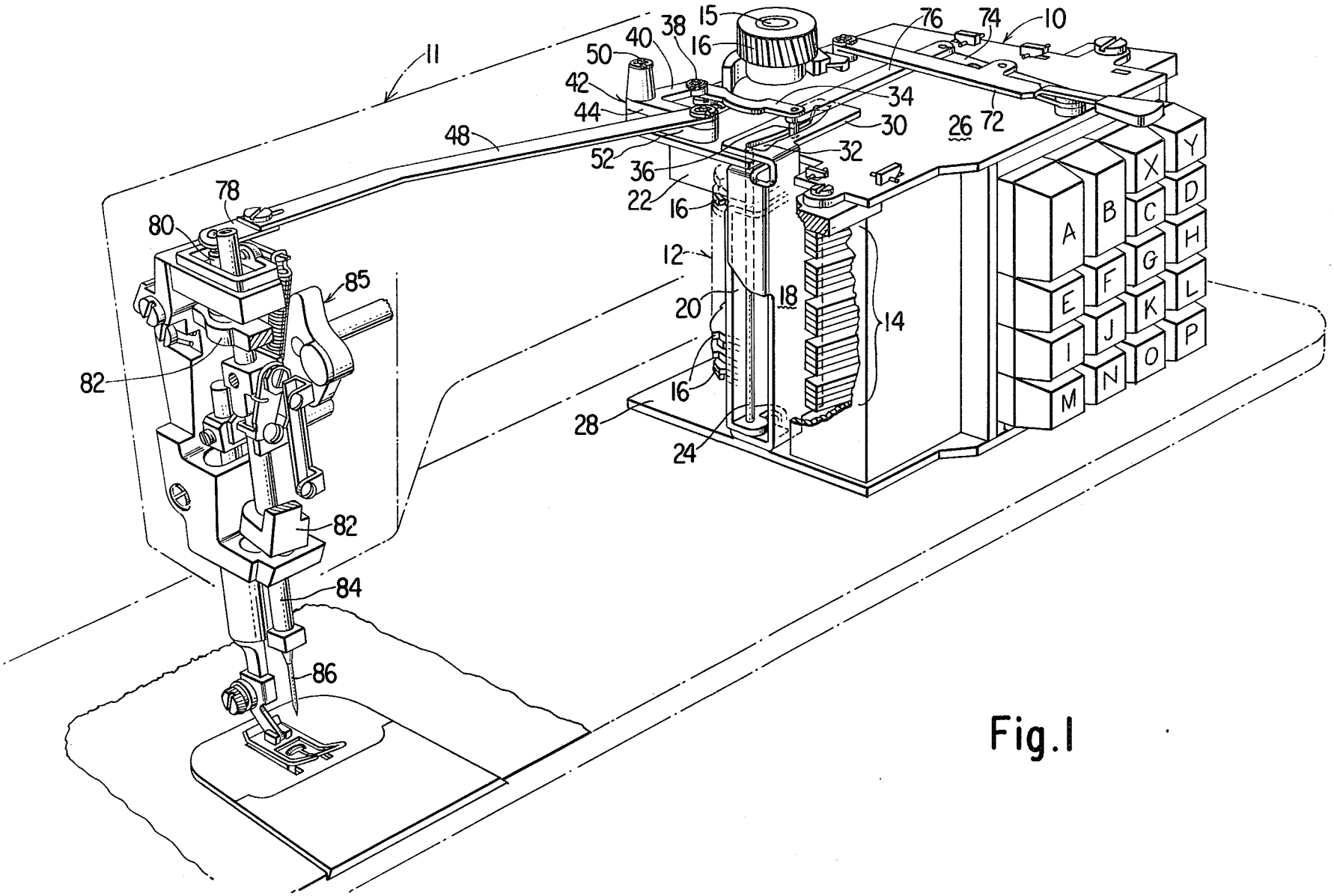
FIG. 1 is a perspective view showing a pattern and buttonhole control arrangement including mechanism according to the invention.

Referring to the drawings, reference character 10 designates a sewing machine pushbutton control module which is generally of the kind shown in U.S. Pat. No. 4,441,440 for "Push-Button Control Module for a Sewing Machine". The module, which is to be understood as being affixed in a machine 11, includes sewing mode selecting pushbuttons A and B for straight and zig-zag stitching, respectively, pushbuttons C through P for pattern sewing, and pushbuttons X and Y for buttonhole sewing. The mode includes a stack 12 of rotatable cams and a stack 14 of pivotally mounted cam followers. The cams are rotatable by a shaft 15 which is driven by a gear 16 during operation of the machine. Each of the cam followers can be selectively positioned by operation of the pushbuttons into engagement at one end with an associated cam of the cam stack, and at the other end with a needle plate 18, feed wobble plate 20 or crank 22. A shaft 24 affixed in a top plate 26 and bottom plate 28 of the module defines a common axis about which needle plate 18, feed wobble plate 20 and crank 22 may be pivoted by the cam followers.

Needle plate 18 terminates at its upper end in a bracket 30 which includes a circularly extending arcuate slot 32. One end of link 34 carries a pin 36 which extends into slot 32, and the opposite end is pivotally connected by a pin 38, at a center defining the arcuate outline of slot 32, to one arm 40 of the bell crank 42. The other arm 44 of the bell crank is pivotally connected at 46 to a needle bar actuating link 48. Bell crank 42 is pivotally mounted between arms 40 and 44 on a stub shaft 50 affixed in a carrier 52. The carrier is pivotally supported on a pin 54 which is located in top plate 26 of module 10 to establish a fixed pivotal axis for the carrier. A pin 56 in an arm 58 of carrier 52 connects the carrier with crank 22 at a slot 59 therein. Another arm 60 of the carrier includes a curved end portion 62 with a terminal slot 64. A latch 66 pivotally mounted on plate 26 at 68 includes an end key 70 engageable at slot 64 with carrier arm 60 for locking the carrier in a fixed position on plate 26 and disengageable from said arm for unlocking the carrier to enable movement of the carrier about its pivotal axis. Latch 66 is normally disposed by a spring 71 with key 70 in slot 64 to lock the carrier 52 in a fixed position on plate 26. The carrier is unlocked by the depression of button X or Y.

Pin 36 is positionable in slot 32 on needle plate 18 with a lever 72 acting through links 74 and 76, and for any particular position of pin 36 in slot 32, the pin is rocked by needle plate 18 about the axis of shaft 24 in response to pivotal movement of plate 18 as determined by a selected follower and actuating cam. Movement of the pin 36 is transmitted through link 34 to bell crank 42 which is thereby caused to pivot on stub shaft 50 and move needle bar actuating link 48 accordingly. As will be made apparent hereinafter, movement of crank 22 by a cam follower can occur only while carrier 52 is unlocked. Movement may then be imparted to the carrier about its pivotal axis by crank 22, and to the pivotal axis of bell crank 42 by the carrier. As the pivotal axis of the bell crank 42 is moved needle bar actuating link 48 which is pivoted on arm 40 of the bell crank is moved accordingly.

As shown, needle bar actuating link 48 connects through an adjustable extension 78 with a needle bar post 80. A gate 82 and needle bar 84 are laterally movable in a manner well known by the post 80 as a needle 86 is reciprocated endwise by driving mechanism 85 which is operably connected to the needle bar.

Figure 2:
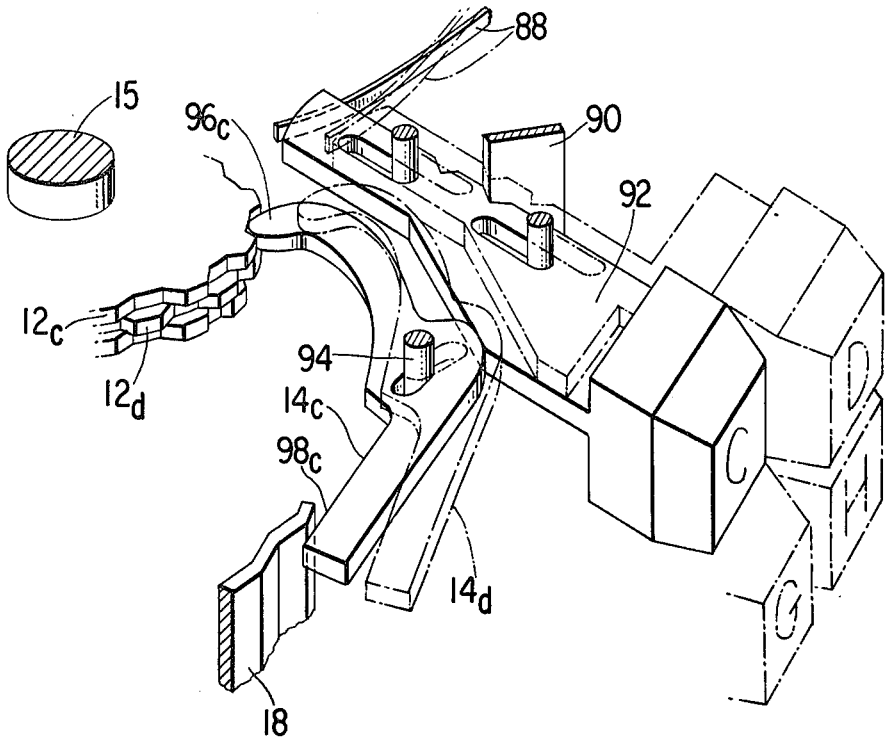
FIGS. 2 and 3 are enlarged fragmentary views showing a portion of the control of FIG. 1.

Any pushbutton of module 10 may be depressed into a position wherein it is held against the outward bias of an associated spring 88 by a latch 90, and when so depressed any button previously moved into a latched position is released and returned by its spring to a normal unactuated position, all as described in U.S. Pat. No. 4,441,440 mentioned hereinbefore. Assuming a pushbutton for pattern sewing, such as pushbutton C, is moved into a latched position (see FIG. 2), an associated cam follower $14_c$ is caused to ride up along an edge of an extension 92 of the pushbutton and move on pin 94 into an activated position of enforced engagement of one end $96_c$ with an associated cam $12_c$ and at the opposite end $98_c$ with needle plate 18. During the rotation of shaft 15 by gear 16, the follower is rocked, in a manner predetermined by the profile of the cam, about the pushbutton extension 92 serving as a supporting fulcrum. The follower positions and imparts pivotal movement to needle plate 18 and the needle plate acting through bracket 30, pin 36, link 34, bell crank 42, needle bar actuating link 48, needle bar post 80 and gate 82 controls the positioning and side to side movement of needle bar 84. The carrier 52 is locked in a fixed position on plate 26 at such time and does not influence the motion of the needle bar.

Figure 3:
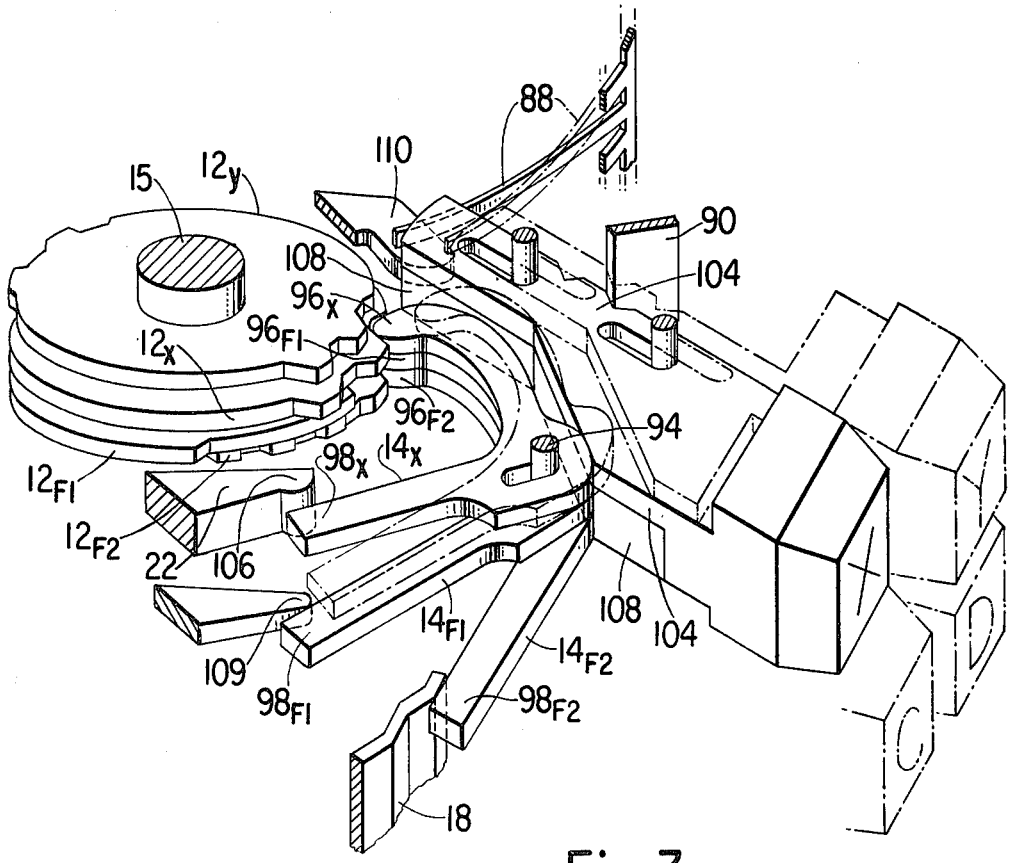
Figure 4:
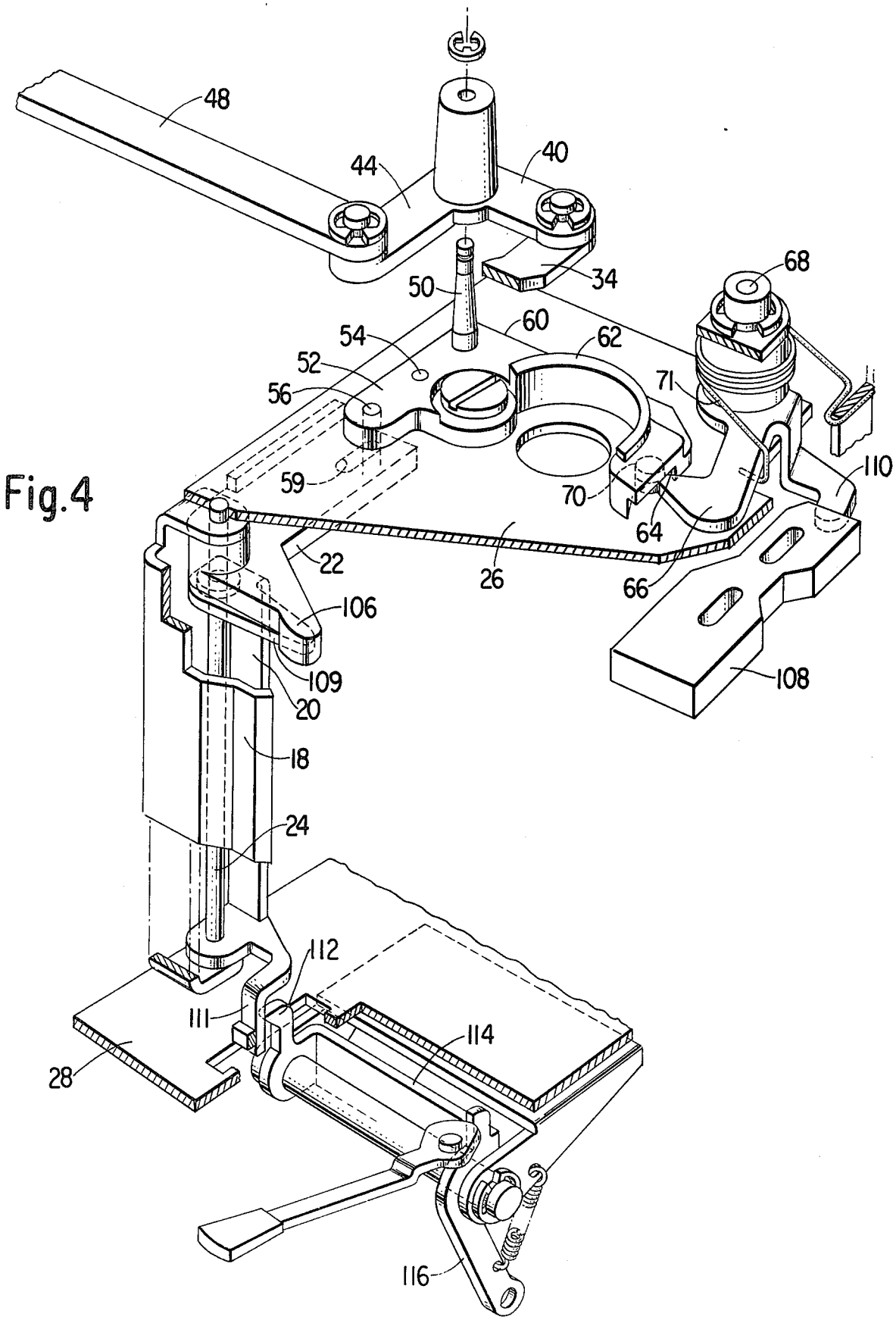
FIG. 4 is another enlarged fragmentary view showing a portion of the control of FIG. 1; and, FIG. 5 is an exploaded perspective view of of a portion of the control of FIG. 1.
Figure 5:
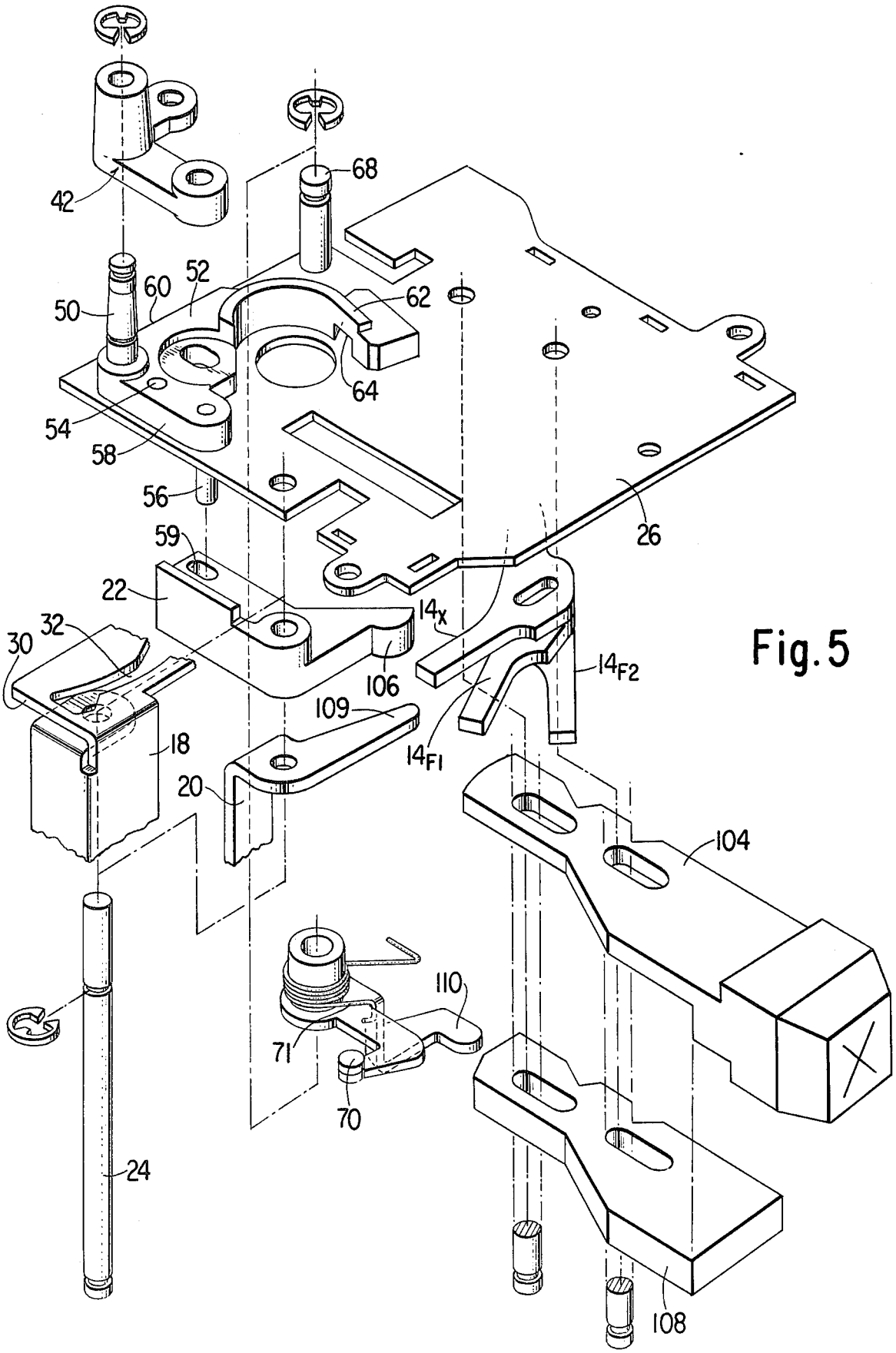

When a pushbutton for initiating buttonhole sewing such as pushbutton X is depressed to a latched position (see FIG. 3) an extension 104 moves an associated cam follower $14_x$ into a supported position thereon, and into forced engagement at opposite ends $96_x$ and $98_x$ with a buttonhole cam $12_x$ and one end 106 of crank 22, respectively. At the same time, a floating extension 108 is caused by button X to move two other cam followers $14_{F1}$ and $14_{F2}$ into supported positions thereon, and into enforced engagement at ends $96_{F1}$ and $96_{F2}$ with associated buttonhole cams $12_{F1}$ and $12_{F2}$, and at opposite ends $98_{F1}$ and $98_{F2}$ with a finger like projecting portion 109 of feed wobble plate 20 and with needle plate 18, respectively. Floating extensions 108 is also caused by the depression of button X to act against an arm 110 on latch 66 and move the latch 66 against the bias of spring 71 as required to unlock carrier 52.

As cam shaft 15 is rotated, crank 22, needle plate 18 and feed wobble plate 20 are moved by the engaging followers in accordance with the profiles of the buttonhole cams. The buttonhole cams are of a well known type used in buttonhole sewing, the buttonhole cam in engagement with the crank associated follower being a needle positioning and barring cam, the buttonhole cam in engagement with the feed wobble plate associated follower being a feed direction controlling cam, and the other buttonhole cam being a needle zig-zag cam. Clutching and tripping control means (not shown) of a kind such as disclosed in U.S. Pat. No. 3,841,246 of John W. Casner et al issued Oct. 15, 1974, drivably connect and disconnect the needle positioning and barring cam to and from drive shaft 15 during the sewing of a buttonhole as required to effect the formation of a buttonhole of predetermined lengths.

As crank 22 is moved by the engaging follower, carrier 52 is pivoted by the crank acting thereon through pin 56 and moves the pivotal axis of bell crank 42 to influence of needle bar 84 to which the bell crank is connected through needle bar actuating link 48, needle bar post 80 and gate 82. Needle plate 18 acting through bracket 30, pin 36, and link 34 pivotes the bell crank on stub shaft 50 and thereby also influences movement of the needle bar. Feed wobble plate 20 acting through extension 111, finger 112, bracket 114 and arm 116 positions feed regulating mechanism (not shown) suitably connected to arm 116 to provide for the feeding of material in a forward and reverse direction during the formation of a buttonhole. Such feed regulating mechanism may be of the kind shown, for example, in U.S. Pat. No. 3,527,183 for "Work Feeding Mechanism for Sewing Machine" of Jan Szostak, issued Sept. 8, 1970.

It is to be understood that the present disclosure relates to a preferred embodiment of the invention which is for purposes of illustration only and is not to be construed as limiting the invention. Numerouse alterations and modifications of the structure herein will suggest themselves to those skilled in the art, and all such modifications which do not depart from the spirit and scope of the invention are intended to be included within the scope of the appended claims.

I claim:

1. Mechanism for controlling needle bight in a sewing machine including a bell crank with an input and an output arm, a needle bar actuating link operably connected to the output arm of the bell crank, a carrier for the bell crank, means mounting the bell crank on the carrier for pivotal movement about an axis thereon, means mounting the carrier for movement about a different axis affixed in the machine, means for locking the carrier in a fixed position in the machine to prevent pivotal movement about said fixed axis and for unlocking the carrier to permit the said pivotal movement thereof, means for imparting needle bight controlling movements for pattern sewing to the input arm of the bell crank when the carrier is locked to cause the bell crank to pivot on the carrier and move the needle bar actuating link, and means for imparting needle bight controlling movements to the input arm of the bell crank and to the carrier when the carrier is unlocked to thereby cause the bell crank and carrier to pivot on their respective axes and influence movement of the needle bar actuating link.

2. The combination of claim 1 wherein the locking and unlocking means includes a latch normally biased into locking engagement with the carrier, and a control member operably associated with the latch for causing the latch to be moved apart from the carrier and the carrier to be thereby freed for movement about the said pivotal axis.

3. The combination of claim 2 wherein the control member is a pushbutton.

4. The combination of claim 3 wherein the latch is mounted for pivotal movement about a fixed axis in the machine into and out of engagement with said carrier.

5. The combination of claim 4 wherein the carrier includes a key engageable with the carrier in a slot for affixing the position of the carrier.

6. The combination of claim 5 wherein the means for imparting needle bight controlling movements to the carrier includes a rotatable cam, a follower movable by said cam, and a pivoted member with one end engageable by the follower and the other end operably connected to the carrier.

* * * * *